US008420940B2

(12) United States Patent
Iwasaki et al.

(10) Patent No.: US 8,420,940 B2
(45) Date of Patent: Apr. 16, 2013

(54) HALOGEN-FREE FLAME-RETARDANT CABLE

(75) Inventors: Makoto Iwasaki, Hitachi (JP); Akinari Nakayama, Hitachinaka (JP)

(73) Assignee: Hitachi Cable, Ltd., Tokyo (JP)

( * ) Notice: Subject to any disclaimer, the term of this patent is extended or adjusted under 35 U.S.C. 154(b) by 297 days.

(21) Appl. No.: 12/829,536

(22) Filed: Jul. 2, 2010

(65) Prior Publication Data

US 2011/0174518 A1 Jul. 21, 2011

(30) Foreign Application Priority Data

Jan. 21, 2010 (JP) ..... 2010-011271

(51) Int. Cl.
*H01B 7/29* (2006.01)

(52) U.S. Cl.
USPC ..... 174/121 A

(58) Field of Classification Search ..... 174/121 A, 174/113 R
See application file for complete search history.

(56) References Cited

U.S. PATENT DOCUMENTS 4,469,718 A * 9/1984 Shirahata et al. ..... 427/120
4,769,179 A * 9/1988 Kato et al. ..... 252/609
2010/0147549 A1* 6/2010 Shiina ..... 174/113

FOREIGN PATENT DOCUMENTS

JP 2007-095439 4/2007

* cited by examiner

*Primary Examiner* — Chau Nguyen
(74) *Attorney, Agent, or Firm* — Scully, Scott, Murphy & Presser, P.C.

(57) ABSTRACT

A halogen-free flame-retardant cable includes a multi-core twisted wire including a plurality of insulated wires twisted together, the plurality of insulated wires each including a conductor and an insulation layer on an outer periphery of the conductor, an inner layer formed on an outer surface of the multi-core twisted wire, and an outer layer formed on the inner layer. The outer layer includes a resin composition including not less than 30 parts by mass of a flame retardant with respect to 100 parts by mass of thermoplastic polyurethane (TPU). The inner layer includes a resin composition comprising an ethylene-vinyl acetate copolymer (EVA) with a vinyl acetate (VA) content of not less than 33%, and the outer layer is subjected to cross-linking treatment.

4 Claims, 1 Drawing Sheet

10 HALOGEN-FREE FLAME-RETARDANT CABLE
11 INSULATED WIRE
12 COVERING LAYER

13 DIE
110 TWISTED PAIR INSULATED WIRE

HALOGEN-FREE FLAME-RETARDANT CABLE

The present application is based on Japanese Patent Application No. 2010-011271 filed on Jan. 21, 2010, the entire contents of which are incorporated herein by reference.

BACKGROUND OF THE INVENTION

1. Field of the Invention

The invention relates to a halogen-free flame-retardant cable in which an outermost layer is formed of a resin composition of melamine cyanurate (MC) and a phosphorus compound blended into thermoplastic polyurethane (TPU and a layer excluding the outermost layer is formed of an ethylene-vinyl acetate copolymer (EVA), thereby suppressing a decrease in bond strength of an insulated wire with a cover layer and having high flame retardance.

2. Description of the Related Art

Thermoplastic polyurethane (TPU) is widely used as a cable coating material used for vehicles, robots or electrical equipments, etc., since it has excellent mechanical characteristics and flexibility at low temperature.

Various characteristics such as flame retardance, heat resistance or abrasion resistance are required for the cable used for the vehicles, robots or electrical equipments.

The major conventional resin composition is a resin composition in which a halogen-based flame retardant or an antimony compound including a bromine atom or a chlorine atom is blended into thermoplastic polyurethane (TPU) in order to obtain the flame retardance.

The resin composition obtained by the conventional art has a problem that harmful gas is generated from a halogen compound included in the flame retardant at the time of burning, or heavy metal blended into a material is eluted at the time of landfill.

JP-A 2007-95439 suggests to use thermoplastic polyurethane as a resin composition for the outermost layer of the cable and resin consisting mainly of an ethylene-vinyl acetate copolymer as a cover layer between an insulated wire and a sheath, and to cross-link the resin composition of the outermost layer by electron beam irradiation.

SUMMARY OF THE INVENTION

However, when the ethylene-vinyl acetate copolymer (EVA) is used for cover layers other than the outermost layer, there is a problem that a cable generates heat due to energy of the electron beam irradiation during the cross-linking of the cover layer using the electron beam irradiation, EVA and TPU are cross-linked in a state that a crystal of EVA is molten and expanded, which leads to that the structure is fixed, and then, a gap occurs between the insulated wire and the cover layer due to shrinkage of the cover layer when the temperature returned to the room temperature after completion of the irradiation, which causes a problem of a decrease in bond strength.

Therefore, it is an object of the invention to provide a halogen-free flame-retardant cable which solves the above-mentioned problems and in which high flame retardance is obtained by using a resin composition of melamine cyanurate (MC) and a phosphorus compound blended into thermoplastic polyurethane (TPU) for an outermost layer of a cover layer and it is possible to suppress a gap generated between the insulated wire and the cover layer even though the electron beam is irradiated, thereby preventing a decrease in bond strength.

(1) According to one embodiment of the embodiment, a halogen-free flame-retardant cable comprises:

a multi-core twisted wire comprising a plurality of insulated wires twisted together, the plurality of insulated wires each comprising a conductor and an insulation layer on an outer periphery of the conductor;

an inner layer formed on an outer surface of the multi-core twisted wire; and an outer layer formed on the inner layer;

wherein the outer layer comprises a resin composition including not less than 30 parts by mass of a flame retardant with respect to 100 parts by mass of thermoplastic polyurethane (TPU);

the inner layer comprises a resin composition comprising an ethylene-vinyl acetate copolymer (EVA) with a vinyl acetate (VA) content of not less than 33%; and the outer layer is subjected to cross-linking treatment.

In the above embodiment (1) of the invention, the following modifications and changes can be made.

(i) The outer layer is cross-linked by electron beam irradiation and further comprises a degree of cross-linking or a gel fraction of not less than 60%.

(ii) The flame retardant comprises a triazine derivative and/or a phosphorus compound.

(iii) 30-100 parts by mass of a triazine derivative and 0-30 parts by mass of a phosphorus compound are included as the flame retardant with respect to 100 parts by mass of the thermoplastic polyurethane (TPU).

Points of the Invention

According to one embodiment of the invention, a halogen-free flame-retardant cable is constructed such that an inner layer thereof comprises a resin composition comprising an ethylene-vinyl acetate copolymer (EVA) with a vinyl acetate (VA) content of not less than 33%. When the VA content of ethylene-vinyl acetate copolymer (EVA) as a major component of the inner layer is less than 33%, a gap is caused between an insulated wire and the inner layer when irradiating electron beam on the cable, and the bond strength decreases. Furthermore, oxygen supply increases, which leads to a decrease in the flame retardance. Therefore, the invention was made by finding the fact that it is possible to prevent the expansion and to suppress the gap by employing EVA having less crystalline component. The crystalline component decreases when the VA content of the EVA is large. 33% or more of the VA content is required to suppress the occurrence of the gap.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described in detail below in conjunction with the appended drawings.

At first, the structure of the halogen-free flame-retardant cable of the invention will be explained referring to FIG. 1.

Figure 1:
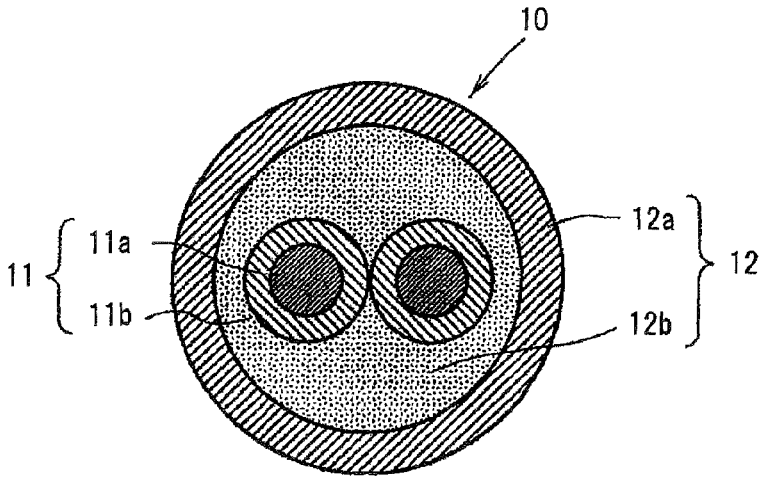
FIG. 1 is a cross sectional view showing a halogen-free flame-retardant cable of the present invention.

In FIG. 1, a halogen-free flame-retardant cable 10 is configured such that a cover layer 12 is formed on an outer periphery of a multi-core twisted wire which is formed by twisting plural insulated wires 11 having an insulation layer 11*b* on an outer periphery of a conductor 11*a*. The cover layer 12 is formed by coating the outer periphery of the multi-core twisted wire with an inner layer 12*b* and then by coating the outer periphery of the inner layer 12*b* with an outer layer (sheath) 12*a*. Alternatively, multiple inner layers 12*b* may be formed.

In the invention, a resin composition consisting mainly of polyethylene is used as a resin material for the insulation layer 11*b* of the insulated wire 11, a resin composition consisting mainly of thermoplastic polyurethane (TPU) is used as a resin material for the outer layer 12*a* and a resin composition consisting mainly of ethylene-vinyl acetate copolymer (EVA) is used as a resin material for the inner layer 12*b*.

It is preferable that the outer layer 12*a* is formed of a resin composition including 30 parts by mass or more of flame retardant per 100 parts by mass of thermoplastic polyurethane (TPU), and a resin composition formed of an ethylene-vinyl acetate copolymer (EVA) having a vinyl acetate (VA) content of 33% or more is used for the inner layer 12*b*.

The inner layer 12*b* is extruded to coat the outer periphery of the multi-core twisted wire which is formed by twisting the plural insulated wires 11, the outer layer 12*a* is extruded to coat the outer periphery of the inner layer 12*b* and is cross-linked by electron beam irradiation, etc., thereby forming the halogen-free flame-retardant cable 10. The degree of cross-linking at this time is preferably 60% or more since the heat resistance is poor at less than 60%.

The thermoplastic polyurethane (TPU), which can be used in the invention, is a resin excellent in flexibility at low temperature, mechanical strength, oil resistance and chemical resistance. The thermoplastic polyurethane includes polyester series urethane resin (adipate series, caprolactone series, polycarbonate series) and polyether series urethane resin.

It is preferable that 30 parts by mass or more of the flame retardant is included per 100 parts by mass of the thermoplastic polyurethane (TPU). Excellent flame retardance may not be obtained in case of less than 30 parts by mass.

In addition, a triazine derivative or a phosphorus compound is preferably used as the flame retardant, which can be used alone or in combination. The triazine derivative includes cyanuric acid, melamine derivative and melamine cyanurate (MC), and use of melamine cyanurate is more preferable.

The amount of the melamine cyanurate (MC) blended into the thermoplastic polyurethane (TPU) which is used for the outer layer should be 30 parts by mass or more since the satisfactory flame retardance cannot be obtained at less than 30 parts by mass. Meanwhile, since there is a possibility that mechanical strength significantly decreases at more than 110 parts by mass, 110 parts by mass or less is preferable and 100 parts by mass or less is more preferable.

Since bloom may occur when more than 35 parts by mass of the phosphorus compound is included, 35 parts by mass or less is preferable and 30 parts by mass or less is more preferable.

The more preferable blending amount is 30-100 parts by mass, preferably 30-50 parts by mass of the melamine cyanurate (MC) and 0-30 parts by mass, preferably 0-10 parts by mass of the phosphorus compound. It is possible to easily ensure the flame retardance, tensile properties and abrasion characteristics in the above range.

The phosphorus compound includes aromatic phosphate such as trimethyl phosphate, triethyl phosphate, triphenyl phosphate, tricresyl phosphate, cresyl phenyl phosphate and cresyl di 2,6-xylenyl phosphate, aromatic condensed phosphate ester such as resorcinol bis-diphenylphosphate, resorcinol-bis-(dixylenyl phosphate) and bisphenol-A bis(diphenyl phosphate), and a phosphazene compound, etc.

Meanwhile, when the VA content of the ethylene-vinyl acetate copolymer (EVA) as a major component of the inner layer, which is used for other than the outer layer, is less than 33%, a gap occurs between the insulated wire and the inner layer when the electron beam is irradiated on the cable, and the bond strength decreases. Furthermore, oxygen supply increases, which leads to a decrease in the flame retardance.

The gap occurs by the following mechanism.

(1) The cable generates heat due to the energy of the electron beam irradiation, and the crystal of the EVA is molten and expanded. (2) The cross-linking reaction occurs in the thermoplastic polyurethane (TPU) and the EVA in the expanded state, and the structure is fixed. (3) When the irradiation is completed, the EVA shrinks by cooling down to the normal temperature. (4) It is considered that the EVA shrink on the thermoplastic polyurethane (TPU) side since the EVA and the insulated wire are not bonded, resulting in the occurrence of the gap therebetween.

Therefore, the invention was made by finding the fact that it is possible to prevent the expansion and to suppress the gap by employing the EVA having less crystalline component.

The crystalline component decreases when the VA content of the EVA is large. 33% or more of the VA content is required to suppress the occurrence of the gap.

EXAMPLES

Table 1 shows Examples 1-11 and Comparative Examples 1 and 2.

TABLE 1

(Unit of blending amount: parts by mass)

| | | Examples | | | | | | | | | | | | |
|---|---|---|---|---|---|---|---|---|---|---|---|---|---|---|
| | | Examples | | | | | | | | | | | Comparative Examples | |
| | Items | 1 | 2 | 3 | 4 | 5 | 6 | 7 | 8 | 9 | 10 | 11 | 1 | 2 |
| Outer layer material | Thermoplastic polyurethane (TPU) [1] | 100 | 100 | 100 | 100 | 100 | 100 | 100 | 100 | 100 | 100 | 100 | 100 | 100 |
| | Melamine cyanurate (MC) [2] | 30 | 30 | 30 | 50 | 100 | 100 | 100 | 30 | 30 | 40 | 110 | 25 | 25 |
| | Aromatic condensed phosphate ester [3] | 0 | 1 | 10 | 30 | 0 | 30 | 30 | 0 | 0 | 35 | 30 | 0 | 0 |
| Inner layer material | Ethylene-vinyl acetate copolymer [4] (VA content = 25%) | | | | | | | | | | | | | 100 |
| | Ethylene-vinyl acetate | | | | | | | 100 | | | | | | |

TABLE 1-continued (Unit of blending amount: parts by mass)

| Items | | Examples | | | | | | | | | | | Comparative Examples | |
|---|---|---|---|---|---|---|---|---|---|---|---|---|---|---|
| | | 1 | 2 | 3 | 4 | 5 | 6 | 7 | 8 | 9 | 10 | 11 | 1 | 2 |
| | copolymer [5] (VA content = 33%) | | | | | | | | | | | | | |
| | Ethylene-vinyl acetate copolymer [6] (VA content = 46%) | 100 | 100 | 100 | 100 | 100 | 100 | | 100 | 100 | 100 | 100 | 100 | |
| Irradiance level (kGy) | | 200 | 200 | 200 | 200 | 200 | 200 | 200 | 100 | 50 | 200 | 200 | 200 | 200 |
| Evaluation | Tensile strength (MPa) | 15.3 | 14.9 | 14.9 | 13.5 | 10.9 | 10.5 | 11.0 | 14.9 | 15.1 | 13.2 | 9.7 | 15.9 | 16.1 |
| | Elongation (%) | 390 | 380 | 380 | 350 | 230 | 220 | 230 | 360 | 400 | 340 | 200 | 380 | 380 |
| | Heat resistance | Pass | Pass | Pass | Pass | Pass | Pass | Pass | Pass | Molten | Pass | Pass | Pass | Pass |
| | Flame retardance (second) | 10 | 5 | 4 | 2 | 3 | 2 | 2 | 13 | 13 | 2 | 2 | 30≦ | 30≦ |
| | Gel fraction (%) | 78 | 78 | 77 | 75 | 73 | 73 | 75 | 62 | 43 | 75 | 77 | 78 | 75 |
| | Abrasion resistance (m) | 23.1 | 22.6 | 21.0 | 18.2 | 11.0 | 10.8 | 11.2 | 21.8 | 22.5 | 20.5 | 9.3 | 23.9 | 24.1 |
| | Bond strength (N) | 42 | 41 | 41 | 42 | 40 | 41 | 40 | 45 | 40 | 41 | 41 | 42 | 5 |
| | Bloom | No | No | No | No | No | No | No | No | No | Present | No | No | No |
| | Comprehensive evaluation | ◎ | ◎ | ◎ | ◎ | ◎ | ◎ | ◎ | ◎ | ○ | ○ | ○ | X | X |

[1] ET890 from BASF Japan Ltd.,
[2] MC-5S from Sakai Chemical Industry Co., Ltd.,
[3] PX-200 from Daihachi Chemical Industry Co., Ltd.,
[4] EV360 from DuPont-Mitsui Polychemicals Co., Ltd,
[5] EV170 from DuPont-Mitsui Polychemicals Co., Ltd,
[6] EV45LX from DuPont-Mitsui Polychemicals Co., Ltd The cables of Examples 1-11 and Comparative Examples 1 and 2 were made as follows.

Low-density polyethylene as an insulating layer is extruded to coat an outer periphery of a conductor formed by twisting 48 wires with a diameter of 0.08 mm, using a 40 mm extruder (L/D=24), so as to have an outer diameter of 1.4 mm. The electron beam was irradiated on the obtained insulated wire at an irradiance level of 100 kGy and two of the insulated wires were twisted together to prepare a multi-core twisted wire.

The above-mentioned multi-core twisted wire was coated with an inner layer material as a cover layer so as to have an outer diameter of 3.4 mm, and an outer layer material as a cover layer was further extruded to coat thereof so as to have an outer diameter of 4.0 mm. The electron beam was irradiated on the obtained cable and the cover layer was cross-linked, thereby making a cable as shown in FIG. 1 which is composed of two cover layers.

The cables were evaluated as follows.

The tensile strength and elongation as tensile properties were evaluated conforming to JISC3005, and 9 MPa or more of tensile strength and 150% or more of breaking elongation were judged as passed.

As for the heat resistance, the cable was coiled to own diameter and was left in an aging tank at 200° C. for 30 minutes, and the cables of which shape was maintained were judged as passed.

As for the flame retardance evaluation, the cable was kept horizontally, flame was applied thereto for 10 seconds and the cables in which the fire went out within 30 seconds after removing the flame were judged as passed. An average value of extinguish time (second) of all tests is shown.

The degree of cross-linking was evaluated as the gel fraction, conforming to AVX of JASOD 608-92.60% or more of the gel fraction was judged as passed.

The abrasion resistance was evaluated by an abrasion tape method of JASOD 608-92, and 9 m or more was judged as passed.

Figure 2:
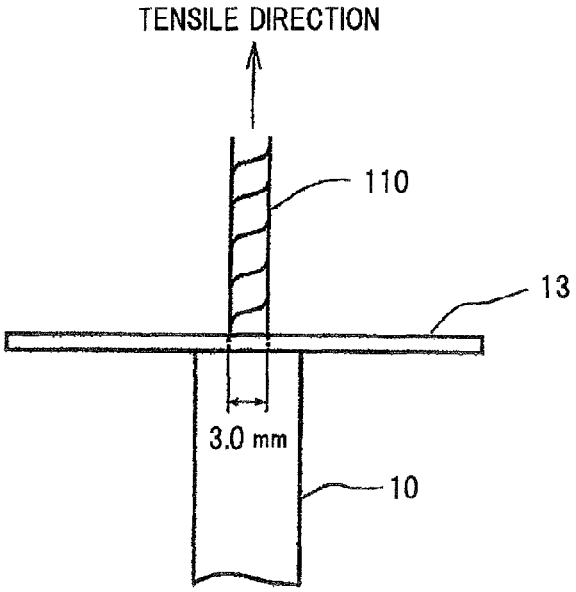
FIG. 2 is an explanatory view showing a test equipment for measuring bond strength in Examples and Comparative Examples of the invention.

For evaluating the bond strength, as shown in FIG. 2, after a twisted pair insulated wire 110 was exposed by removing the cover layer 75 mm from one end of the cable 10 which was cut in a length of 100 mm (leaving 25 mm of the cover layer), a die 13 having a hole diameter of 3.0 mm was inserted from the twisted pair insulated wire 110 side so as to be in contact with the remaining cover layer, the twisted pair insulated wire 110 was pulled using a Shopper-type tensile tester, and a force by which the cover layer is pulled off was measured. 20N or more was judged as passed.

As the evaluation of the bloom, the presence of the bloom was examined by observing the outer layer of the cable using a 50-power optical microscope.

In the above evaluation method, the comprehensive evaluation is indicated by a double circle "◎" (excellent) for the cables which passed all evaluations, a single circle "○" (good) for the cables which passed the flame retardance and the bond strength, and "X" (not good) for the cables which failed either the flame retardance or the bond strength.

Examples 1-11

Using ET890 (from BASF Japan Ltd.) as the thermoplastic polyurethane (TPU), MC-5S (from Sakai Chemical Industry Co., Ltd.) as the melamine cyanurate (MC) and the aromatic condensed phosphate ester PX-200 (from Daihachi Chemical Industry Co., Ltd.) as the phosphorus compound for the outer layer material and using the EV170 (from DuPont-Mitsui Polychemicals Co., Ltd) as EVA (VA=33%) or EV45LX (from DuPont-Mitsui Polychemicals Co., Ltd) as EVA (VA=46%) for the inner layer material, the inner and outer layers were formed at the composition shown in Table 1, and were cross-linked at an electron beam irradiance level of 200-50 kGy.

Comparative Example 1

An outer layer material including 25 parts by mass of melamine cyanurate (MC) per 100 parts by mass of thermoplastic polyurethane (TPU) and EVA (VA=46%) as an inner layer material were used and cross-linked at the irradiance level of 200 kGy.

Comparative Example 2

An outer layer material including 25 parts by mass of melamine cyanurate (MC) per 100 parts by mass of thermoplastic polyurethane (TPU) and EVA (VA=25%) as an inner layer material were used and cross-linked at the irradiance level of 200 kGy.

In Table 1, the comprehensive evaluations of Examples 1-7 are double circles "◎" since satisfactory results were obtained in all evaluations at not less than 30 parts by mass and not more than 100 parts by mass of melamine cyanurate (MC).

Examples 8 and 9 are examples in which the irradiance level is set 100 kGy and 50 kGy, respectively. Although the gel friction as the evaluation of the degree of cross-linking is low compared with Example 1, all evaluations for Example 8 at 100 kGy were satisfactory, and thus, the comprehensive evaluation is excellent "◎". In contrast, although the heat resistance at 50 kGy in Example 9 was evaluated as molten, it passed the evaluations for the bond strength and the bloom, hence, the comprehensive evaluation is good "○".

Example 10 is an example in which the melamine cyanurate is 40 parts by mass and the phosphorus compound is 35 parts by mass. Although the bloom was observed since the amount of the blended phosphorus compound is more than Example 4 in which the melamine cyanurate is 50 parts by mass and the phosphorus compound is 30 parts by mass, there is practically no problem and the flame retardance and the bond strength are satisfactory, hence, the comprehensive evaluation is good "○".

Example 11 is an example in which the melamine cyanurate is 110 parts by mass and the phosphorus compound is 30 parts by mass. Although the tensile strength was 9.7 MPa since the amount of the blended melamine cyanurate is more than Example 6 in which the melamine cyanurate is 100 parts by mass and the phosphorus compound is 30 parts by mass, the flame retardance and the bond strength are satisfactory, hence, the comprehensive evaluation is good "○".

Since the blending amount of the melamine cyanurate in Comparative Examples 1 and 2, 25 parts by mass, is less than those of Examples, the flame retardance was evaluated as failed. In addition, the bond strength of Comparative Example 1 is satisfactory since the EVA having the VA content of 46% is used, however, that of Comparative Example 2 is low since the EVA having the VA content of 25% is used.

Therefore, it was found that the VA content of EVA should be 33% or more.

As described above, it is not possible to obtain sufficient flame retardance when the blending amount of the flame retardant added to the thermoplastic polyurethane (TPU) as an outer layer material is small, and the mechanical characteristics may decrease or the bloom may occur when the blending amount is excessive. In addition, it is not possible to obtain sufficient bond strength unless the EVA with high VA content (33% or more) is used as an inner layer material. Therefore, it is necessary to add suitable melamine cyanurate (MC) and phosphorus compound to the thermoplastic polyurethane (TPU) and to use the EVA with high VA content for the inner layer.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A halogen-free flame-retardant cable, comprising:

a multi-core twisted wire comprising a plurality of insulated wires twisted together, the plurality of insulated wires each comprising a conductor and an insulation layer on an outer periphery of the conductor;

an inner layer formed on an outer surface of the multi-core twisted wire; and an outer layer formed on the inner layer;

wherein the outer layer comprises a resin composition including not less than 30 parts by mass of a flame retardant with respect to 100 parts by mass of thermoplastic polyurethane (TPU);

the inner layer consists of an ethylene-vinyl acetate copolymer (EVA) with a vinyl acetate (VA) content of not less than 33%; and the outer layer is cross-linked by electron beam irradiation.

2. The halogen-free flame-retardant cable according to claim 1, wherein the outer layer comprises a degree of cross-linking or a gel fraction of not less than 60%.

3. The halogen-free flame-retardant cable of claim 1, wherein the cable has a bond strength of 20N or more, measured by pulling, 25 mm of the inner layer and the outer layer by the plurality of wires, through a die.

4. The halogen-free flame-retardant cable of claim 3, wherein the cable has a bond strength of 40N or more.

* * * * *